US009167341B2

(12) United States Patent
Bogdanov

(10) Patent No.: US 9,167,341 B2
(45) Date of Patent: Oct. 20, 2015

(54) MULTIPLE-WAY LOUDSPEAKER

(71) Applicant: Vadim Bogdanov, Birzu (LT)

(72) Inventor: Vadim Bogdanov, Birzu (LT)

(73) Assignee: ProDigitAlive e.K., Hamburg (DE)

( * ) Notice: Subject to any disclaimer, the term of this patent is extended or adjusted under 35 U.S.C. 154(b) by 0 days.

(21) Appl. No.: 14/362,633

(22) PCT Filed: Nov. 26, 2012

(86) PCT No.: PCT/EP2012/073610
§ 371 (c)(1),
(2) Date: Jun. 4, 2014

(87) PCT Pub. No.: WO2013/083425
PCT Pub. Date: Jun. 13, 2013

(65) Prior Publication Data

US 2014/0348347 A1 Nov. 27, 2014

(30) Foreign Application Priority Data

Dec. 5, 2011 (DE) ..... 10 2011 056 028

(51) Int. Cl.
*H04R 9/06* (2006.01)
*H04R 1/34* (2006.01)
*H04R 1/26* (2006.01)

(52) U.S. Cl.
CPC . *H04R 1/345* (2013.01); *H04R 1/26* (2013.01)

(58) Field of Classification Search
CPC ..... H04R 1/00; H04R 1/02; H04R 1/28; H04R 9/06; H04R 2201/401; H04R 2201/405; H04R 2205/022
USPC ..... 381/182, 335, 345, 351–352
See application file for complete search history.

(56) References Cited

U.S. PATENT DOCUMENTS

2005/0207593 A1 9/2005 Praestgaard

FOREIGN PATENT DOCUMENTS

DE 196 39 159 4/1998
DE 10 2007 019450 10/2008

*Primary Examiner* — Suhan Ni
(74) *Attorney, Agent, or Firm* — Bay State IP, LLC

(57) ABSTRACT

The invention relates to a loudspeaker (1) for filling a room with sound, having a tweeter (2) with a high-frequency diaphragm (12), which generates a high-frequency sound cone (22) with a high-frequency main radiation direction (13) during operation, and having at least one further tweeter (3) with a further diaphragm (8) and a further main radiation direction (7), wherein the high-frequency main radiation direction (13) is arranged transversely with respect to the further main radiation direction (7) in such a manner that the high-frequency diaphragm (12) is arranged opposite a reflection wall (14) spaced apart from the latter by a clearance (9), and the high-frequency main radiation direction (13) is directed towards the reflection wall (14) during operation, and the clearance (9) has openings (16, 17, 18) for the exit of high-frequency sound waves towards the room to be filled with sound.

5 Claims, 3 Drawing Sheets

MULTIPLE-WAY LOUDSPEAKER

CROSS REFERENCE TO RELATED APPLICATION

This application is for entry into the U.S. National Phase under §371 for International Application No. PCT/EP2012/073610 having an international filing date of Nov. 26, 2012, and from which priority is claimed under all applicable sections of Title of the United States Code including, but not limited to, Sections 120, 363, and 365(c), and which in turn claims priority under 35 USC 119 to German Patent Application No. 10 2011 056 028.9 filed on Dec. 12, 2011.

BACKGROUND OF THE INVENTION

1. Field of the Invention

The invention relates to a loudspeaker according to the preamble of Claim 1.

2. Description of the Related Art

Loudspeakers, in particular multiple-way loudspeakers, have naturally long been known in the prior art. By way of example, a multiple-way loudspeaker is known from DE 10 2008 016 570 A1.

A loudspeaker with a plurality of individual loudspeakers, which are directed towards one another inside a loudspeaker housing in such a way that the direction of the sound radiation of each loudspeaker is directed towards a centre axis of a funnel neck, is known from DE 30 37 496 A1. In this case all the loudspeakers nevertheless radiate only towards the front side through the funnel neck.

A loudspeaker arrangement in a multiple-way system is known from DE 40 36 152 A1, in which loudspeakers for low frequency and mid-range frequency are directed rigidly forwards, whilst the loudspeaker for high frequency is mounted in a rotatable manner. In this case too, the sound cone of the tweeter is kept narrow.

A loudspeaker box with an active auxiliary loudspeaker is known from DE 21 09 758 A1. The two loudspeakers are connected to each other by way of a continuous volume, the compression—generated inside the volume—of one loudspeaker being compensated by the diaphragm movement of the other loudspeaker.

A loudspeaker system is known from EP 0 204 106 A1, in which two individual loudspeakers are arranged at an angle to each other on a front side of a box and radiate towards the front side.

A loudspeaker arrangement with individual loudspeakers arranged around a housing on the outside is known from U.S. Pat. No. 4,006,308.

An omnidirectionally radiating horn, which is rotationally symmetrical about a vertical axis of rotation and which has an upper part and a lower part which together have a sphere as an envelope, is known from DE 10 2007 019 450 A1.

SUMMARY OF THE INVENTION

The object of the invention is to provide a loudspeaker with an improved spatial radiation behaviour.

This object is attained by a loudspeaker specified in the introduction and having the features of Claim 1. Preferred embodiments form the subject matter of the Sub-Claims.

The loudspeaker according to the invention is a multiple-way loudspeaker which has at least one tweeter and a further driver, preferably a mid-range driver/woofer, at a distance therefrom and formed separately. For a further embodiment of the invention, a separate mid-range driver and a separate woofer and/or still further drivers are provided instead of a common further driver. An external outline shape of the loudspeaker is substantially cuboidal.

According to the invention the high-frequency driver has a high-frequency diaphragm which is arranged opposite a reflecting wall at a distance by a free space and which generates a sound cone preferably issuing at a right angle from the high-frequency diaphragm during operation and having a high-frequency main radiation direction. The high-frequency main radiation direction is preferably directed at a right angle to the reflecting wall. It is advantageous for the reflecting wall to be designed in the form of a straight face. The reflecting wall is made parallel to the high-frequency diaphragm along its entire extension.

The free space has openings for the exit of the high-frequency sound waves to the room to be exposed to sound. As a result, the sound cone of the high tones is increased into the room to be exposed to sound.

In one embodiment of the invention the openings of the free space are preferably formed not only towards the front side but also towards the sides and optionally even towards the rear side. On account of the orientation of the tweeter towards a reflecting wall, the radiation behaviour—substantially one-dimensional according to the prior art—of the high frequencies is additionally scattered, since the high frequencies reflected by the reflecting wall can pass through all the openings of the free space and can thus have a radiation behaviour which is directed at least in three directions into the room to be exposed to sound. The reflecting wall can have a flat surface or a non-flat surface. In the second embodiment of the reflecting wall it is preferable for small obliquely arranged parcels to be provided, which promote reflections in the direction of the openings of the free space. The reflecting wall separates the resonance space from the free space preferably completely. The two spaces are decoupled acoustically and are completely separate from each other.

It is preferable for the free space to be provided between the tweeter and the at least one further driver.

The further driver is advantageously arranged in a wall of a resonance space which is preferably provided below the free space in the loudspeaker as viewed with respect to the floor. The resonance space is preferably dimensioned in accordance with the frequencies of the further tones, in particular the lower tones or possibly the mid-range tones. As a result, the resonance space makes it possible for the energy of the further tones, which is not radiated into the room by way of the front side but is radiated downwards into the resonance space, to be absorbed by oscillations of the walls of the resonance member and also to be radiated in the other spatial directions, in particular to the side or by way of the rear wall.

This property of the resonance space is no longer present or is present only to a much lower degree for high frequencies. According to the prior art, although loudspeakers have quite a broad radiation behaviour in the low tones, they have only quite a narrow sound cone in the high tones into the room to be exposed to sound. The radiation behaviour is broadened according to the invention in the high tones and is thus improved.

It is advantageous for the free space to be completely closed towards the rear side of the loudspeaker. The rear side is understood in this case to be the side of the loudspeaker facing away from the room to be exposed to sound. It is advantageous for the free space to have openings only towards the front side and towards the two sides, but not towards the rear side, since as a rule the loudspeaker stands against a wall and a radiation capacity towards the front side and the two sides is perfectly sufficient to expose the room to sound in an adequate manner.

It is preferable for the free space not to be completely opened towards the front side and towards the sides, but to have at least one support on grounds of stability, so that a roof area of the loudspeaker in which the tweeter is fitted is connected to the resonance space of the loudspeaker by way of the continuous rear wall and by way of two lateral front supports and is sufficiently stable despite the three openings. Further supports can also of course be provided.

It is preferable for exactly one support to be provided. As a result, the radiated sound waves are disturbed to a particularly low degree.

In a preferred embodiment of the invention a housing of the loudspeaker is made rectangular, preferably square, in a cross-section orientated parallel to the floor, and a support is provided at each of the corners of the roof portion and of the free space. As a result, the loudspeaker receives an adequate degree of stability and is nevertheless capable of being produced inexpensively.

BRIEF DESCRIPTION OF THE DRAWINGS

The invention is described by way of example with reference to four figures. In this case

DETAILED DESCRIPTION OF THE PREFERRED EMBODIMENTS

Figure 1:
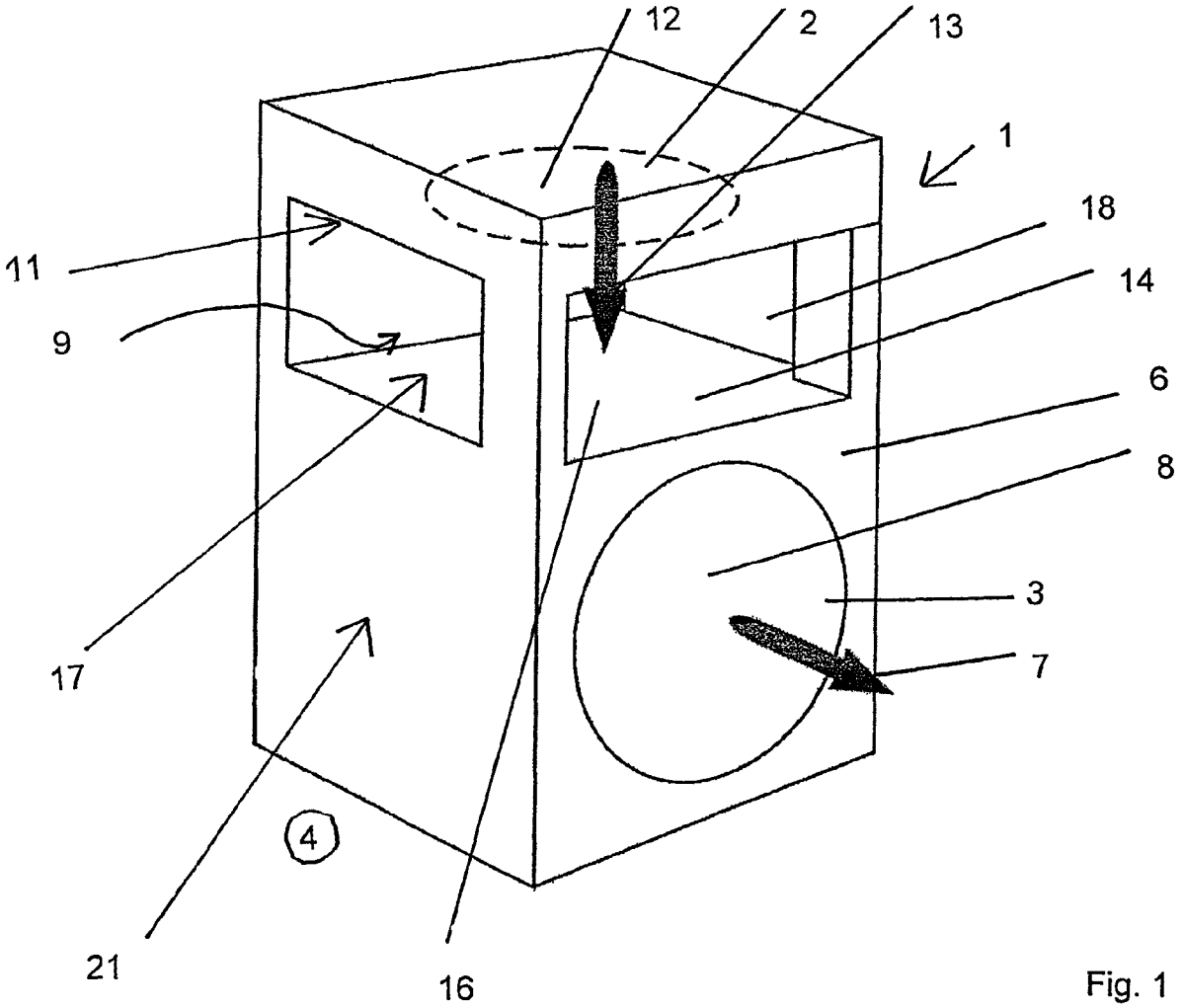
FIG. 1 is a perspective view of a loudspeaker according to the invention in a view from obliquely in front.

The loudspeaker 1 according to the invention with a tweeter 2 and a mid-range driver/woofer 3 is illustrated diagrammatically in FIG. 1. The loudspeaker 1 in FIG. 1 rests on a floor 4 of a room to be exposed to sound and the mid-range driver/woofer 3 provided in the region facing the floor 4 is arranged on the front side 6 of the loudspeaker 1 and radiates into the room to be exposed to sound. A main radiation direction 7 of the mid-range driver/woofer 3 is arranged vertically on a diaphragm 8.

A free space 9, on the inner wall 11 of which opposite the mid-range driver/woofer 3 and remote from the floor is arranged a tweeter 2, is provided at a distance from the floor 4, above the mid-range driver/woofer 3. A high-frequency diaphragm 12 of the tweeter 2 extends parallel to the floor 4, at a right angle to the diaphragm 8 of the mid-range driver/woofer 3. The tweeter 2 radiates into the free space 9 with a high-frequency main radiation direction 13 which is at a right angle to the high-frequency diaphragm 12 and is directed towards a reflecting wall 14 which forms an inner wall of the free space 9 on the floor side. The high-frequency sound waves are reflected on the reflecting wall 14 and can be radiated in three directions by front and lateral openings 16, 17, 18 of the free space 9 into the room to be exposed to sound.

The mid-range driver/woofer 3 is arranged on the floor 4 in the front side 6 of the loudspeaker 1 which has a resonance space 21 in the portion on the floor 4. Although the mid-range driver/woofer 3 thus radiates predominantly towards the front in the main radiation direction 7, it also radiates, in particular, in the two lateral directions by way of resonance effects and oscillation excitations of the lateral wall and the rear wall of the resonance space 21. The mid-range driver/woofer 3 also radiates, however, towards the rear side of the loudspeaker on account of the effects described.

Figure 2:
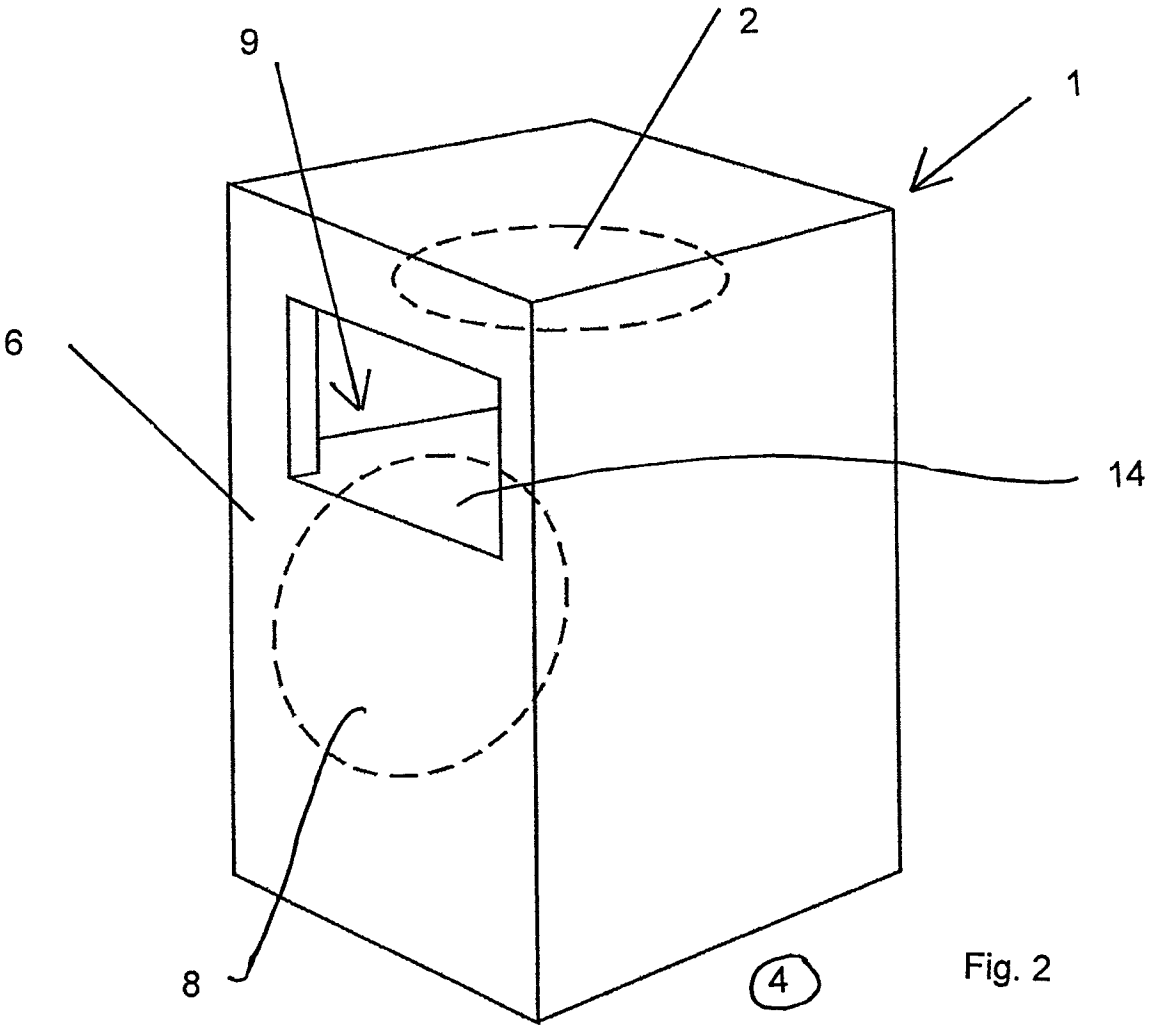
FIG. 2 is a view of the loudspeaker in FIG. 1 from obliquely behind.

FIG. 2 shows the loudspeaker 1 in FIG. 1 in a view obliquely from the rear. In FIG. 2 the closed rear side of the loudspeaker 1 may be seen, and the mid-range driver/woofer 3 arranged on the front side 6 of the loudspeaker 1 and the free space 9 of the loudspeaker 1 and a tweeter 2 provided on the inner wall 11 on the floor and remote from the free space 9 are indicated translucently. The rear wall of the loudspeaker 1 is completely closed. On account of the reflection of the sound waves on the reflecting wall 14 the tweeter 2 radiates only towards the front side 6 and towards the two sides by way of the three openings 16, 17, 18 provided therefor in the wall of the loudspeaker 1.

Figure 3A:
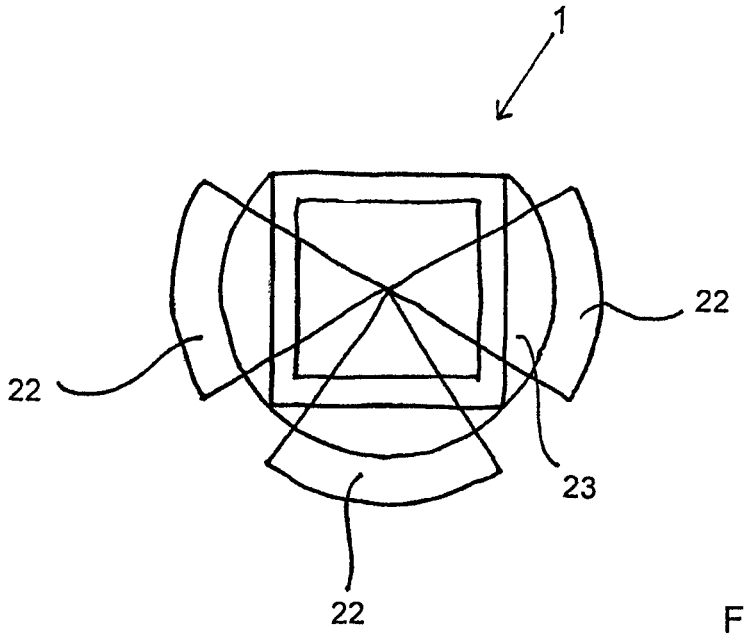
FIG. 3*a* is a diagrammatic illustration of the radiation angle of the high and low frequencies of the loudspeaker according to the invention in FIGS. 1 and 2.
Figure 3B:
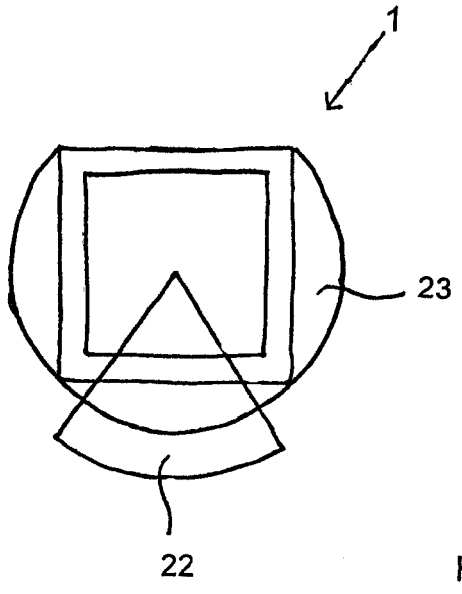
FIG. 3*b* shows a conventional 2-way loudspeaker; radiation angle for high and low frequencies.

The radiation behaviour of the low frequencies is illustrated in FIGS. 3*a*, 3*b* in comparison with the radiation behaviour of the high frequencies. The radiation behaviour for the loudspeaker according to the invention is shown in FIG. 3*a* and that for the loudspeaker according to the prior art is shown in FIG. 3*b*.

FIGS. 3*a* and 3*b* show a similar radiation behaviour with respect to the low frequencies. The mid-range driver/woofer 3 is the same in the case of the loudspeakers of FIGS. 3*a* and 3*b*. The low tones are radiated into the whole of the room to be exposed to sound, as is shown in FIGS. 1 and 2.

The high-frequency diaphragm 12 of the tweeter 2 directed into the free space 9 at a right angle to the floor 4 results in an improved spatial radiation behaviour of the high-frequency tones as compared with the known prior art illustrated in FIG. 3*b*. A high-frequency sound cone is illustrated in FIG. 3*a* and FIG. 3*b*.

FIG. 3*a* shows the radiation behaviour of the loudspeaker in FIGS. 1 and 2 separated according to high frequencies and low frequencies. Since the low-frequency diaphragm 8 radiates into the resonance space 21 of the loudspeaker 1, part of the energy of the low frequencies is absorbed by the walls of the resonance space 21 and is therefore also radiated laterally and towards the rear side. A low-frequency sound cone 23 is opened approximately 270° and is directed towards the front side 6 and towards the two sides. The radiation behaviour and the shape of the low-frequency sound cone 23 of the woofer 3 are substantially the same in the two figures.

The tweeter 2 radiates at a right angle to the reflecting wall 14. As a result of being reflected on the reflecting wall 14 the high frequencies in FIG. 3*a* likewise radiate in three different directions by way of the three openings 16, 17, 18 provided in the free space 9 into the room to be exposed to sound. The high-frequency sound cone 22 divided into three according to the invention is illustrated in FIG. 3*a*.

In contrast, the radiation behaviour of a conventional loudspeaker is illustrated according to FIG. 3*b*, the tweeter 2 and the woofer 3 of which [are] likewise provided on the front side 6 above the woofer 3, preferably at a distance from the floor 4. The high frequencies of the conventional loudspeaker preferably radiate exclusively towards the front, since the resonance effect of the resonance space 21 turns out to be significantly less at the high frequencies than at the low frequencies, for which the resonance space is designed. The high-frequency sound cone 22 is directed exclusively towards the front. As in the case of the invention the low-frequency sound cone 23 is directed both towards the front and towards the sides.

LIST OF REFERENCES

1 loudspeaker
2 tweeter

3 mid-range driver/woofer
4 floor
6 front side of the loudspeaker
7 main radiation direction of the mid-range driver/woofer
8 diaphragm
9 free space
11 inner wall on the floor side
12 high-frequency diaphragm
13 high-frequency main radiation direction
14 reflecting wall
16 front opening
17 lateral opening
18 lateral opening
21 resonance space
22 high-frequency sound cone
23 low-frequency sound cone

The invention claimed is:

1. A loudspeaker for exposing a room to sound comprising:

a tweeter (2) with a high-frequency diaphragm (12) which during operation generates a high-frequency sound cone (22) with a high-frequency main radiation direction (13); and with at least one further driver (3) with a further diaphragm (8) and a further main radiation direction (7), wherein the high-frequency main radiation direction (13) is arranged transversely to the further main radiation direction (7);

whereby the high-frequency diaphragm (12) is arranged opposite a reflecting wall (14) at a distance by a free space (9), and the high-frequency main radiation direction (13) is directed towards the reflecting wall (14) during operation and the free space (9) has openings (16, 17, 18) for the exit of high-frequency sound waves towards the room to be exposed to sound characterized by a resonance space (21) in the frontside of which facing the room to be exposed to sound the at least one further drive (3) is provided, and in that the resonance space (21) is separated from the free space (9) by the reflecting wall (14) and in that the free space (9) is closed completely towards the rear side.

2. A loudspeaker according to claim 1, characterized in that the free space (9) is provided between the tweeter (2) and the at least one further driver (3).

3. A loudspeaker according to claim 1, characterized in that the supports between the tweeter (2) and the resonance space (21) are arranged at the outer corners of the free space (9).

4. A loudspeaker according to claim 1, characterized in that a housing is made rectangular over the entire height thereof in a cross-section orientated parallel to the base (4).

5. A loudspeaker according to claim 1, characterized in that the free space (9) has openings (16, 17, 18) towards the front side (6) and the two sides.

* * * * *